US009347241B1

(12) United States Patent
Peng

(10) Patent No.: US 9,347,241 B1
(45) Date of Patent: May 24, 2016

(54) PUSHBUTTON-TYPE EASY-CODE-CHANGE HANDLE LOCK

(71) Applicants: Fu Chang Locks Mfg. Corp., New Taipei (TW); Leon Specialty Inc., New Taipei (TW)

(72) Inventor: Fu-Chang Peng, New Taipei (TW)

(73) Assignees: FU CHANG LOCKS MFG. CORP., New Taipei (TW); LEON SPECIALTY INC., New Taipei (TW)

( * ) Notice: Subject to any disclaimer, the term of this patent is extended or adjusted under 35 U.S.C. 154(b) by 0 days.

(21) Appl. No.: 14/574,406

(22) Filed: Dec. 18, 2014

(51) Int. Cl.
*E05B 37/16* (2006.01)
*E05B 37/00* (2006.01)
*E05C 1/08* (2006.01)

(52) U.S. Cl.
CPC . *E05B 37/00* (2013.01); *E05C 1/08* (2013.01); *E05B 37/16* (2013.01); *Y10T 70/5788* (2015.04); *Y10T 70/722* (2015.04); *Y10T 70/7226* (2015.04)

(58) Field of Classification Search
CPC ..... E05B 37/00; E05B 37/16; E05B 37/163; E05B 37/166; E05B 37/30; E05C 1/08; Y10T 70/5814; Y10T 70/5788; Y10T 70/7215; Y10T 70/722; Y10T 70/7226; Y10T 70/7232
USPC ..... 70/214, 220, 298, 299, 297, 300
See application file for complete search history.

(56) References Cited

U.S. PATENT DOCUMENTS

| | | | | |
|---|---|---|---|---|
| 4,748,833 | A * | 6/1988 | Nagasawa | E05B 37/16 70/214 |
| 6,298,698 | B1 * | 10/2001 | Nakajima | E05B 37/16 70/214 |
| 6,334,346 | B1 * | 1/2002 | Wang | E05B 37/16 70/214 |
| 7,043,948 | B1 * | 5/2006 | Wang | E05B 37/16 70/214 |
| 8,347,673 | B2 * | 1/2013 | Wang | E05B 37/16 70/214 |
| 8,683,832 | B2 * | 4/2014 | Watanabe | E05B 37/16 70/214 |
| 2003/0126896 | A1 * | 7/2003 | Mori | E05B 37/16 70/214 |
| 2004/0261477 | A1 * | 12/2004 | Wang | E05B 37/166 70/214 |
| 2008/0115546 | A1 * | 5/2008 | Hu | E05B 13/004 70/214 |

* cited by examiner

*Primary Examiner* — Lloyd Gall
(74) *Attorney, Agent, or Firm* — Leong C. Lei

(57) ABSTRACT

A pushbutton type easy-code-change handle lock includes an outdoor assembly, a latch bolt arresting member, a latch bolt, and an indoor assembly. The outdoor assembly is mounted to an outside surface of a door panel and is coupled to an end of the latch bolt arresting member. The latch bolt arresting member drives the latch bolt to move. The indoor assembly is coupled to an opposite end of the latch bolt arresting member. The outdoor assembly includes a mechanical combination lock. When a user enters a correct combination of codes, the mechanical combination lock is operated and the external door handle and the latch bolt are operated synchronously to open the door; and if no code is provided, a key may be used to open the door; and if both codes and key are not provided, the external door handle and the latch bolt cannot be operated synchronously.

2 Claims, 17 Drawing Sheets

PUSHBUTTON-TYPE EASY-CODE-CHANGE HANDLE LOCK

TECHNICAL FIELD OF THE INVENTION

The present invention generally relates to a door lock, and more particularly to a pushbutton-type easy-code-change handle lock.

DESCRIPTION OF THE PRIOR ART

Modern people are increasingly concerned about home security and safety of lives and properties and thus they put more and more demands on door access security to prevent break-in and invasion of thefts and burglars. Modern household often use multiple locks for doors to achieve home security.

To effectively enhance home security and to meet market demands, a variety of electronic door locks are currently available in the market. To use, a combination of codes that is set in advance must be entered and then a key may be used to release the lock in order to open the door for entry. Although such an electronic lock greatly improve home security, if the code combination is forgotten or the key is left behind, it often needs to violently swing the door handle and break the electronic lock in order to get into the house. However, the electronic lock that is so broken is generally damaged permanently and cannot be re-used. The expense that consumers need to spend for purchasing and maintaining would be greatly raised. Thus, burglars and thefts would gain more opportunity to break in and invade the house. Apparently, the conventional device has various shortcomings and is not an ideal design. Further improvement is thus required.

On the other hand, a pushbutton type mechanical combination lock is easy and convenient for use and has enhanced confidentiality and security, making it widely used in the market. However, the conventional pushbutton type mechanical combination lock suffers difficult of code change. A number of parts must be removed first before code change can be done. This leads to inconvenience of the necessity of assembling and also causes inconvenience of use.

To improve the drawbacks of the conventional devices, the present invention provides a pushbutton type easy-code-change handle lock that shows the following advantages:

(1) The present invention provides a mechanical combination lock to replace the conventionally used electronic locks in order to greatly reduce the cost.

(2) The present invention reduces the number of parts arranged between a code-change shaft and a code-change device and makes the code-change shaft a combination of multiple functions so as to greatly lower down the precision of machining of the code-change shaft and the code-change device thereby greatly reducing the manufacturing cost.

(3) The present invention shows excellent industrial utilization.

In light of the forgoing, the present invention aims to provide a solution that overcomes the shortcomings of the prior art.

SUMMARY OF THE INVENTION

An object of the present invention is to provide a pushbutton type easy-code-change handle lock so that with the design and application of the present invention for being combined with a door lock, a user is allowed to save cost and a manufacturer is allowed to reduce the cost for machining.

To achieve the above object, the present invention provides a pushbutton type easy-code-change handle lock, which comprises an outdoor assembly, a latch bolt arresting member, and an indoor assembly. The outdoor assembly is mounted to an outside surface of a door panel and comprises an external door handle, an external escutcheon plate, an external handle coupling block, an elastic element arresting block, a burglary protection block, an outdoor arresting member, a mounting plate, and an outdoor fixing plate. The external escutcheon plate comprises a mechanical combination lock mounted thereto. The external handle coupling block, the elastic element arresting block, the burglary protection block, and the outdoor arresting member are sequentially coupled to the external escutcheon plate and then coupled with the external door handle so as to extend through the outdoor assembly and be fixed inside the external escutcheon plate by the mounting plate with the outdoor fixing plate fixing the outdoor assembly. The latch bolt arresting member is coupled with the outdoor arresting member and extends through a latch bolt. The indoor assembly is mounted to an inside surface of the door panel and comprises an internal door handle, an internal handle coupling block, an internal escutcheon plate, an elastic element arresting block, an indoor arresting member, and an indoor fixing plate. The internal handle coupling block, the elastic element arresting block, and the indoor arresting member are sequentially coupled to the internal escutcheon plate and then coupled with the internal door handle so as to extend through the indoor assembly and be fixed to the indoor assembly by the indoor fixing plate. The mechanical combination lock comprises a plurality of code change shafts, a code change device, and a code board. The code change shafts each comprise two position-limiting slots and a code channel formed therein. The code change device is arranged in combination with the position-limiting slots. The code board is fit to the code change shafts. The code channels are engageable with the code change device. As such, a pushbutton type easy-code-change handle lock is formed. When a user enters a correct combination of codes, the mechanical combination lock is operated and the external door handle and the latch bolt are operated synchronously to open the door; and if no code is provided, a key may be used to open the door; and if both codes and key are not provided, the external door handle and the latch bolt cannot be operated synchronously. Thus, the use is easy and confidentiality and security are enhanced, allowing for wide application in the market.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
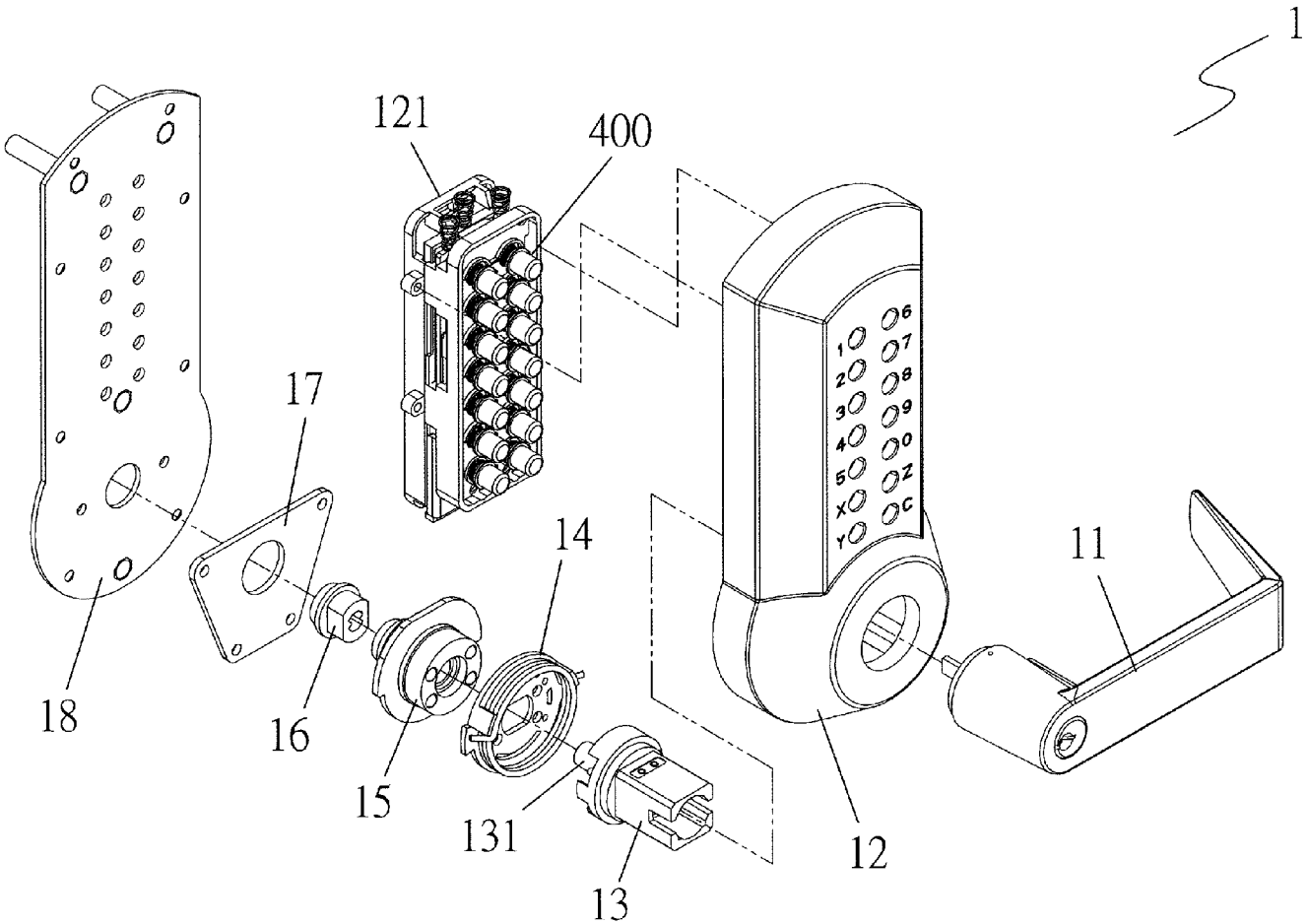
FIG. 1 is an exploded view of a portion of the present invention.
Figure 2:
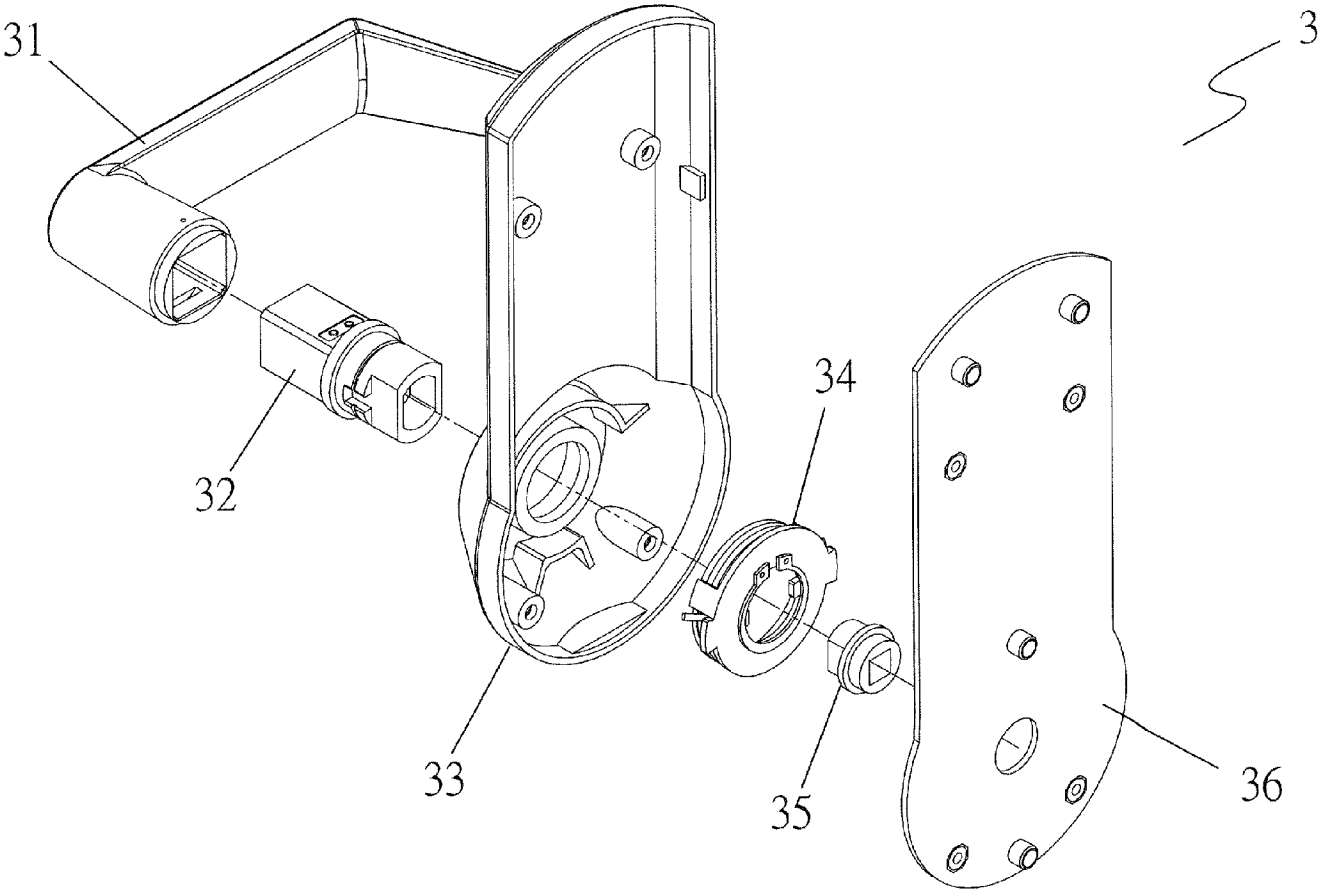
FIG. 2 is an exploded view of a portion of the present invention.
Figure 3:
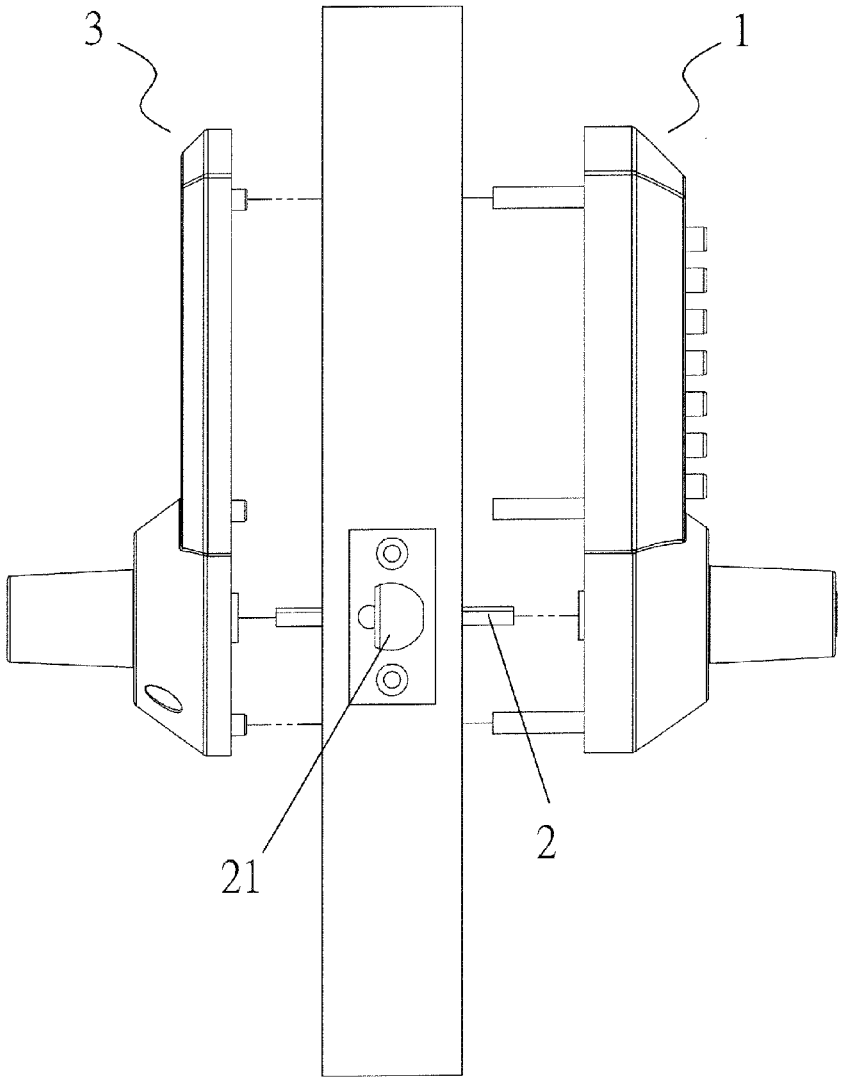
FIG. 3 is an exploded view of a portion of the present invention.
Figure 4:
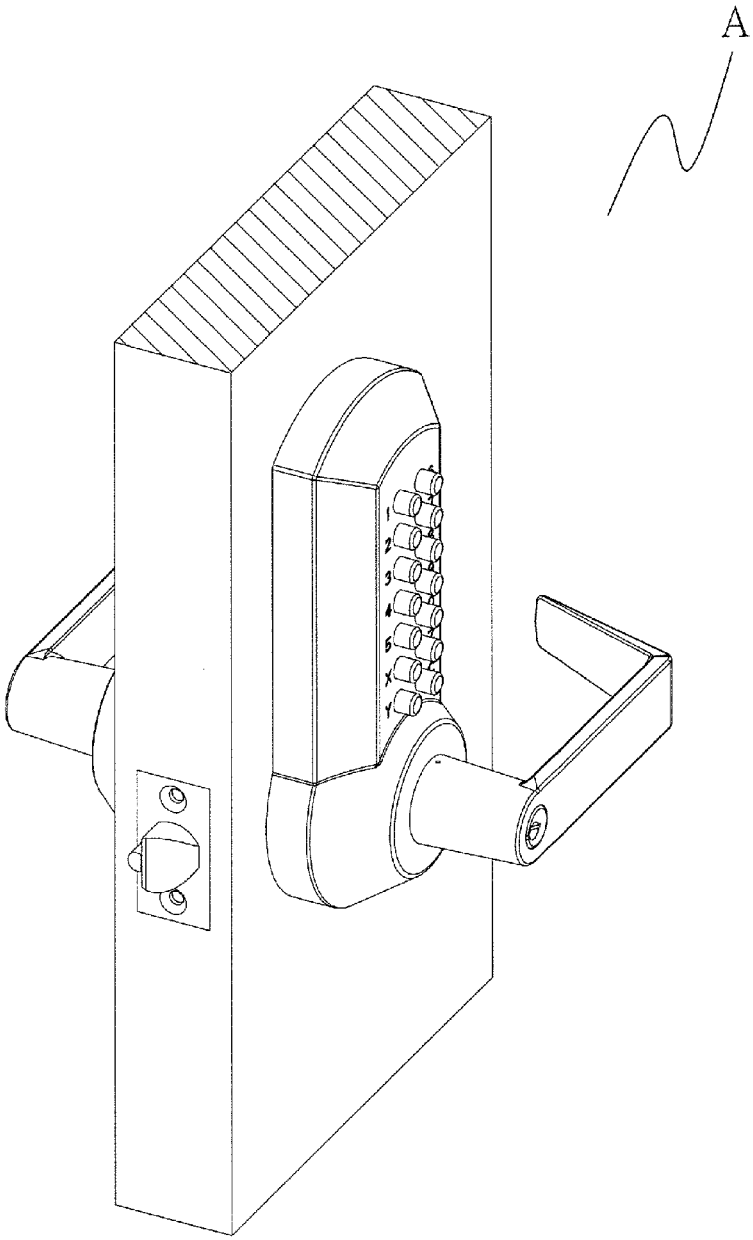
FIG. 4 is a perspective view showing the present invention in an assembled form.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-4, 13, and 17, which are respectively exploded views of portions of the present invention, a perspective view showing the present invention in an assembled form, and schematic views illustrating outdoor and indoor assemblies of the present invention, as shown in the drawings, the present invention provides a pushbutton type easy-code-change handle lock, which comprises: an outdoor assembly 1, a latch bolt arresting member 2, and an indoor assembly 3. The outdoor assembly 1 is mounted to an outside surface of a door panel and comprises an external door handle 11, an external escutcheon plate 12, an external handle coupling block 13, an elastic element arresting block 14, a burglary protection block 15, an outdoor arresting member 16, a mounting plate 17, and an outdoor fixing plate 18. The external escutcheon plate 12 comprises a mechanical combination lock 121 mounted thereto. The external handle coupling block 13, the elastic element arresting block 14, the burglary protection block 15, and the outdoor arresting member 16 are sequentially coupled to the external escutcheon plate 12 and then coupled with the external door handle 11 so as to extend through the outdoor assembly 1 and be fixed inside the external escutcheon plate 12 by the mounting plate 17 with the outdoor fixing plate 18 fixing the outdoor assembly 1. The latch bolt arresting member 2 is coupled with the outdoor arresting member 16 and extends through a latch bolt 21. The indoor assembly 3 is mounted to an inside surface of the door panel and comprises an internal door handle 31, an internal handle coupling block 32, an internal escutcheon plate 33, an elastic element arresting block 34, an indoor arresting member 35, and an indoor fixing plate 36. The internal handle coupling block 32, the elastic element arresting block 34, and the indoor arresting member 35 are sequentially coupled to the internal escutcheon plate 33 and then coupled with the internal door handle 31 so as to extend through the indoor assembly 3 and be fixed to the indoor assembly 3 by the indoor fixing plate 36. The coupling block of the external door handle 11 comprises a rotation connection block, a keyway, a lock cylinder, and a projection pillar, which constitute no novel part of the present invention and will not be further described. The projection pillar is coupled to the rotation connection block. The external escutcheon plate 12 comprises a pushbutton assembly 400 for setting the mechanical combination lock 121. As such, a pushbutton type easy-code-change handle lock according to the present invention is formed.

Figure 5:
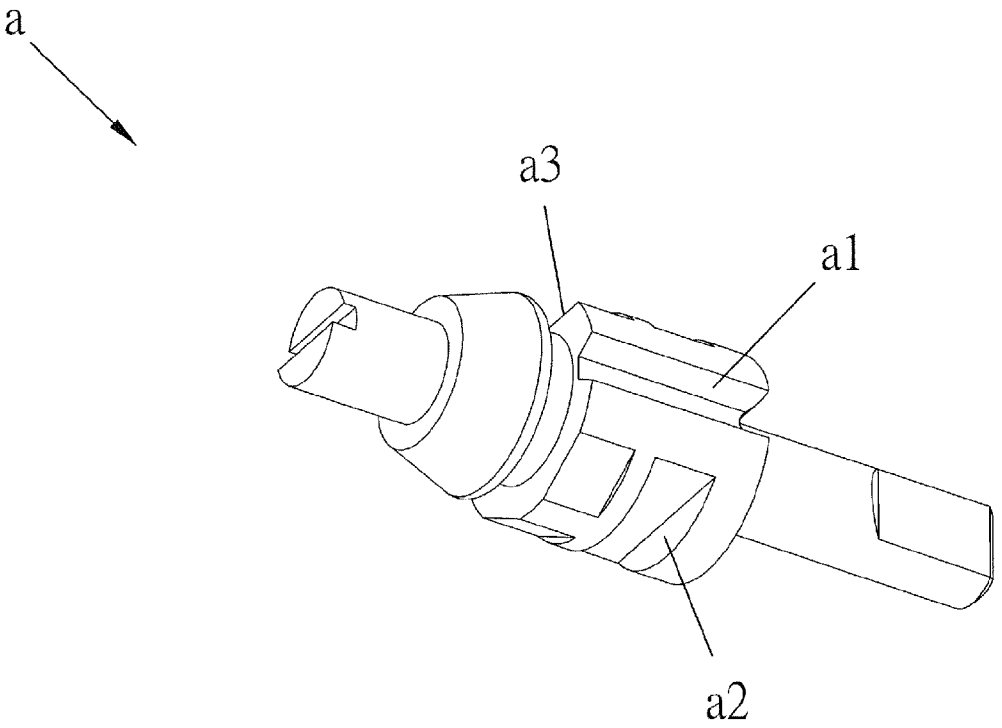
FIG. 5 is an enlarged view showing a code change shaft of the present invention.
Figure 6:
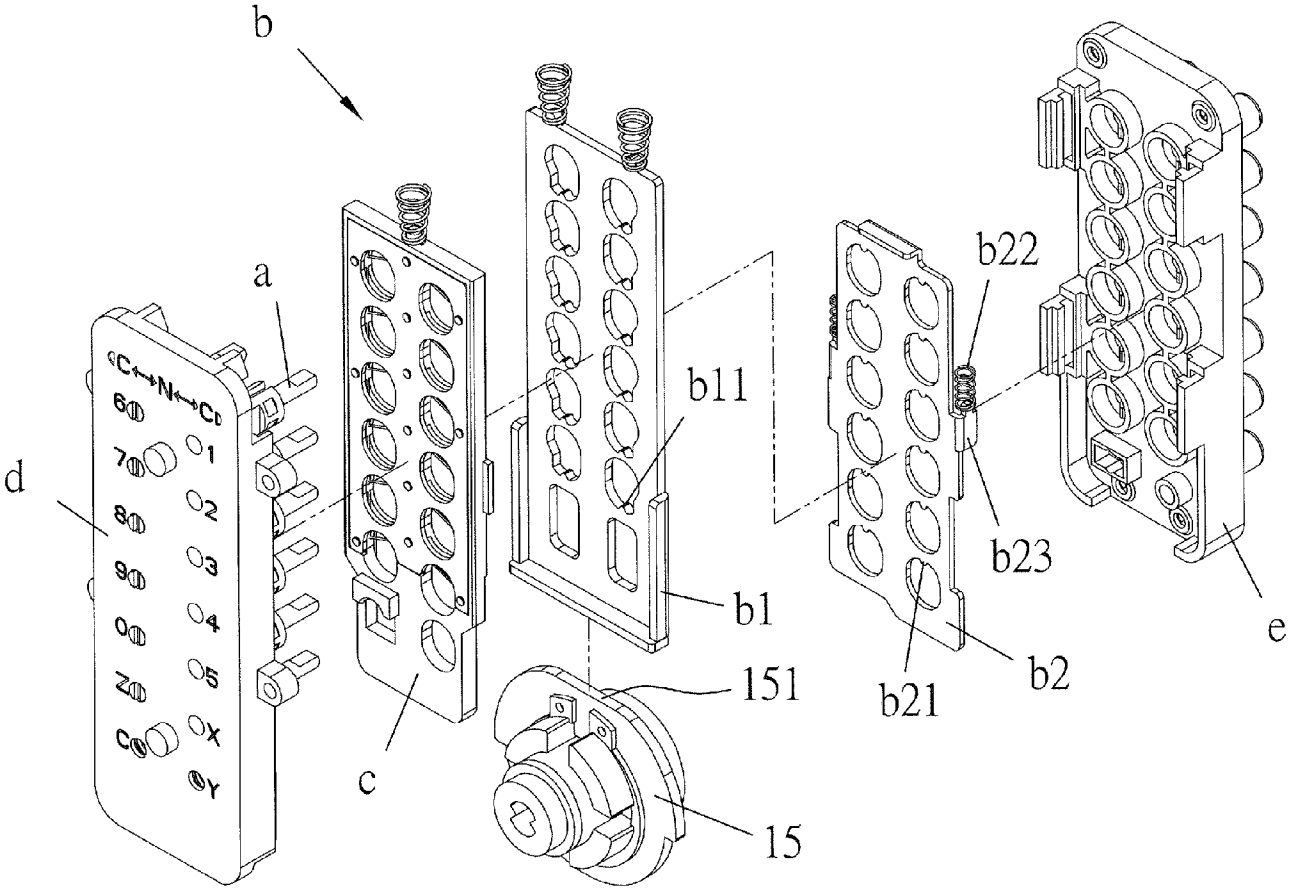
FIG. 6 is an exploded view showing a mechanical combination lock according to the present invention.
Figure 7:
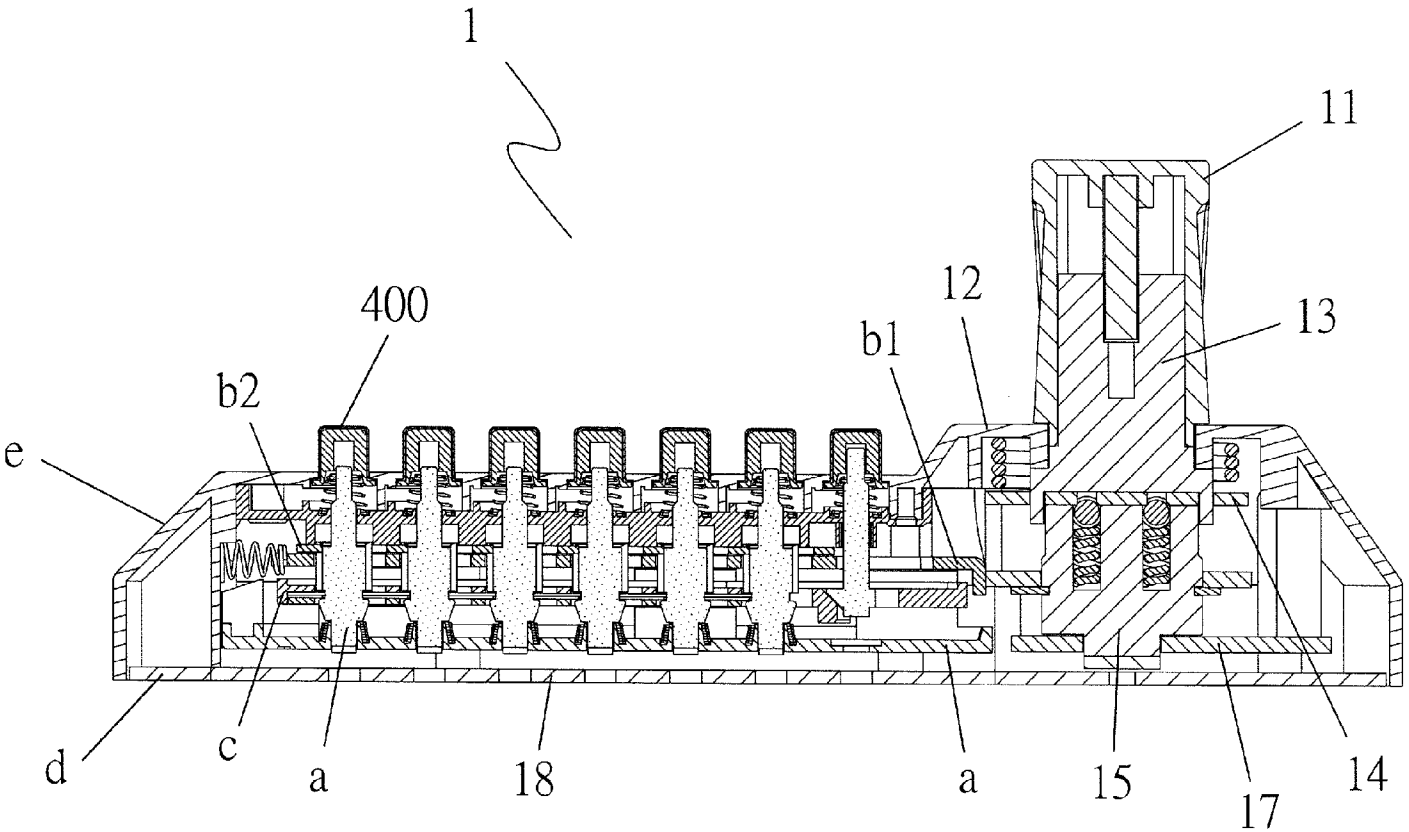
FIG. 7 is a cross-sectional view of an external door handle of the present invention.

Referring to FIGS. 5, 6, and 7, which are respectively an enlarged view showing a code change shaft of the present invention, an exploded view showing the mechanical combination lock of the present invention, and a cross-sectional view of the external door handle of the present invention, as shown in the drawings, the present invention comprises a plurality of code change shafts a respectively coupled to pushbuttons of the pushbutton assembly 400 (see FIG. 7), a code change device b, a code board c fit to the code change shafts, a pushbutton support plate d, and a rear cover e. The code change shafts a each comprise two position-limiting slots a1 and a code channel a2 formed therein. The code change device b is arranged in combination with the position-limiting slots a1. The code change device b comprises a code-change push plate b1 and a code-change plate b2. The pushbutton support plate d, the code board c, the code-change push plate b1, the code-change plate b2, and the rear cover e are sequentially fit to the code change shafts a in such a way that the code channels a2 mate the code-change plate b2 of the code change device b. The code-change push plate b1 and the code-change plate b2 are respectively formed with first engagement blocks b11 and the second engagement blocks b21 in such a way that the first engagement blocks b11 and the second engagement block b21 respectively mates the two position-limiting slots a1 of each code change shaft. In pushing a combination of codes, when the codes so pushed are correct, due to the mating established between the code-change plate b2 and the code channels a2, in carrying out an unlocking operation with a key, the code-change plate b2 can be pushed and moved to allow for the performance of the unlocking operation; and when the codes pushed are incorrect, the code-change plate b2 and the code channel a2 are shifted away from each other and the code-change plate b2 gets jammed is prevented from moving so that the code-change plate b2 cannot be pushed and thus unlocking is not possible.

Figure 8:
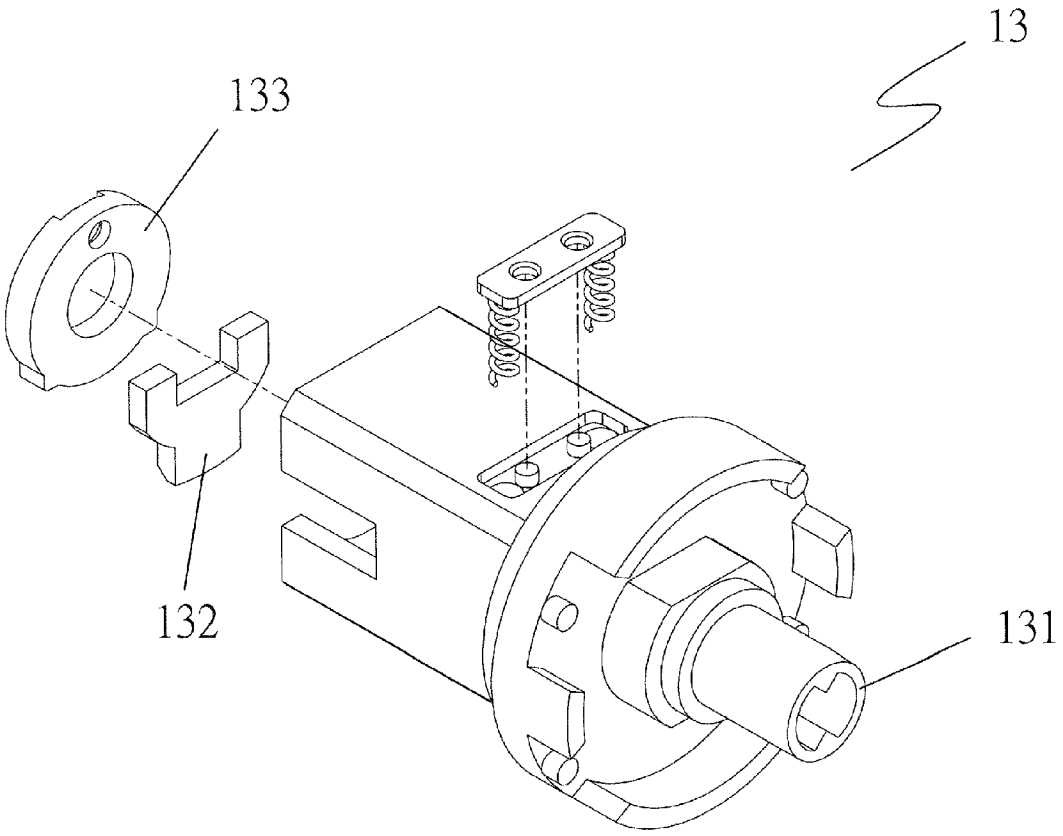
FIG. 8 is an exploded view of an external handle coupling block of the present invention.
Figure 9:
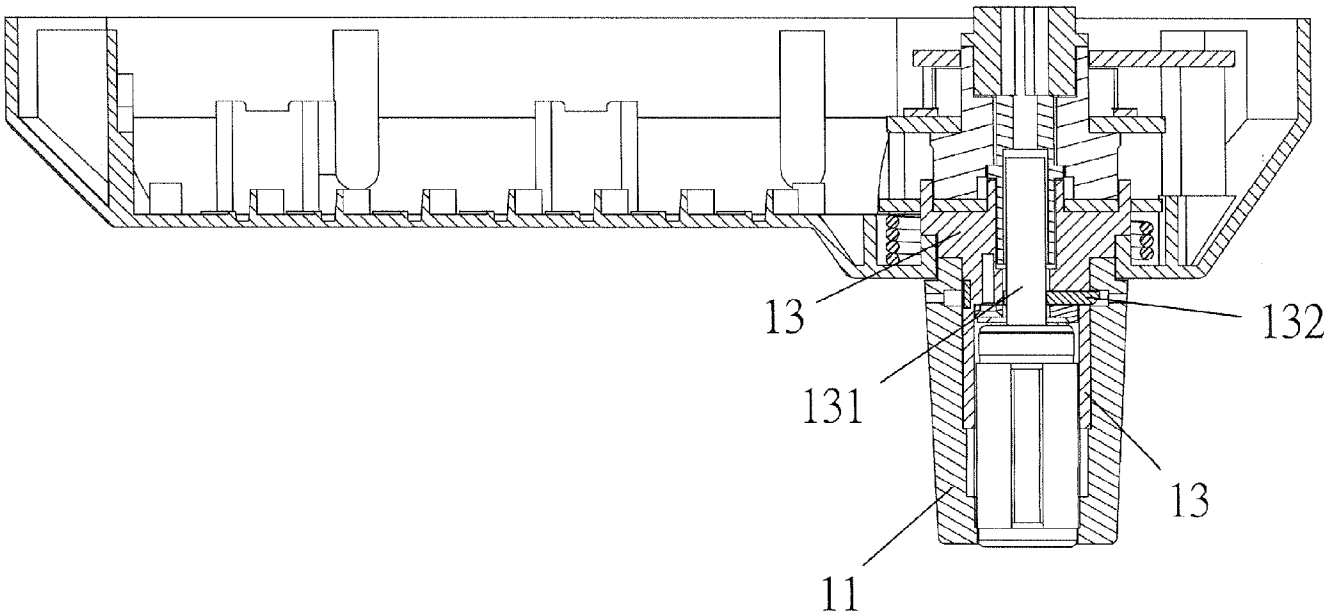
FIG. 9 is a schematic view illustrating coupling engagement of the external handle coupling block and the external door handle of the present invention.

Further referring to FIGS. 8 and 9, which are respectively an exploded view of an external handle coupling block of the present invention and a schematic view illustrating coupling engagement of the external handle coupling block and the external door handle of the present invention, as shown in the drawings, the external handle coupling block 13 comprises a rotation connection block 131 operatively coupled to the external door handle and the latch bolt arresting member and also comprises an engagement plate 132 for engagement with the external door handle 11 and also comprises a retention plate 133 arranged at an outer side of the engagement plate 132 for fixing and retaining the engagement plate 132.

Figure 10:
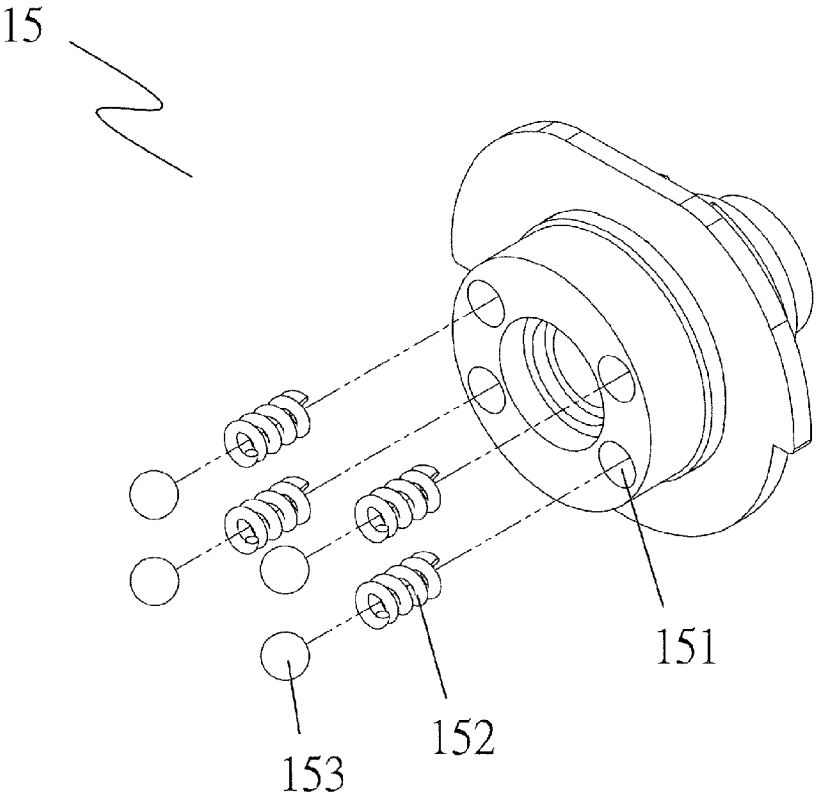
FIG. 10 is an exploded view of a burglary protection block of the present invention.
Figure 11:
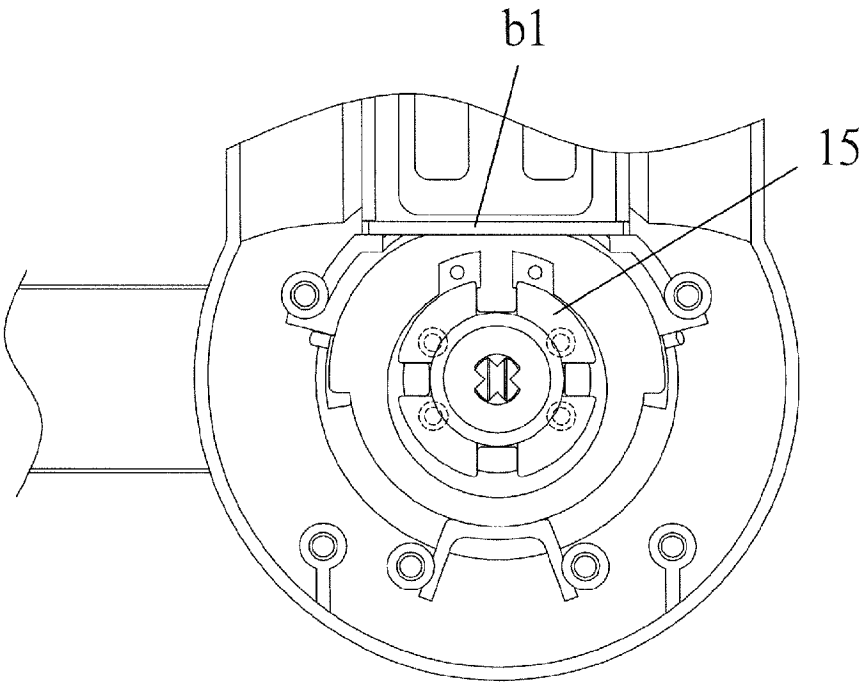
FIG. 11 is a schematic view illustrating installation of the burglary protection block of the present invention.
Figure 12:
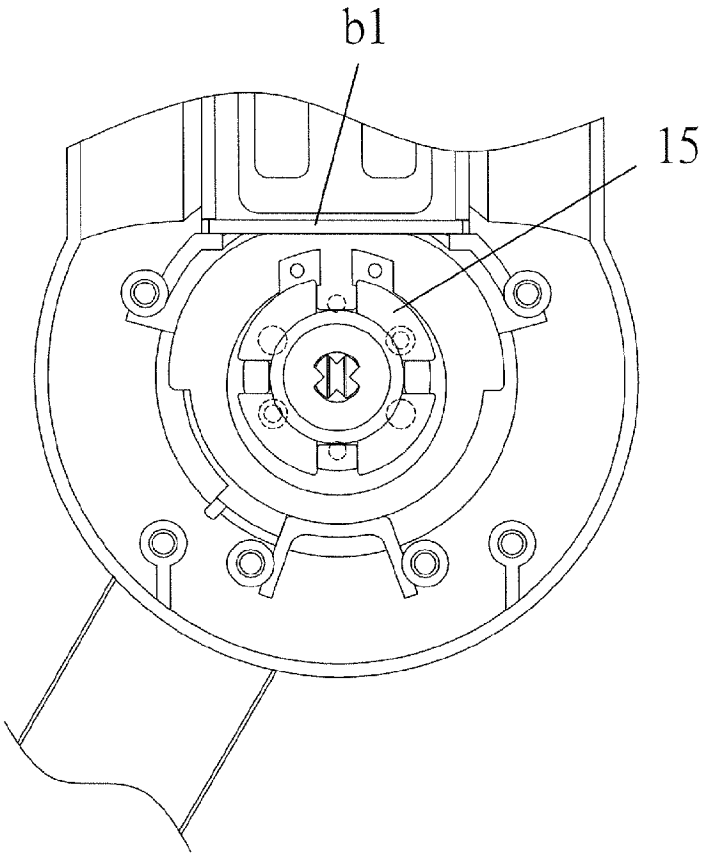
FIG. 12 is a schematic view illustrating an operation of the burglary protection block according to the present invention.
Figure 13:
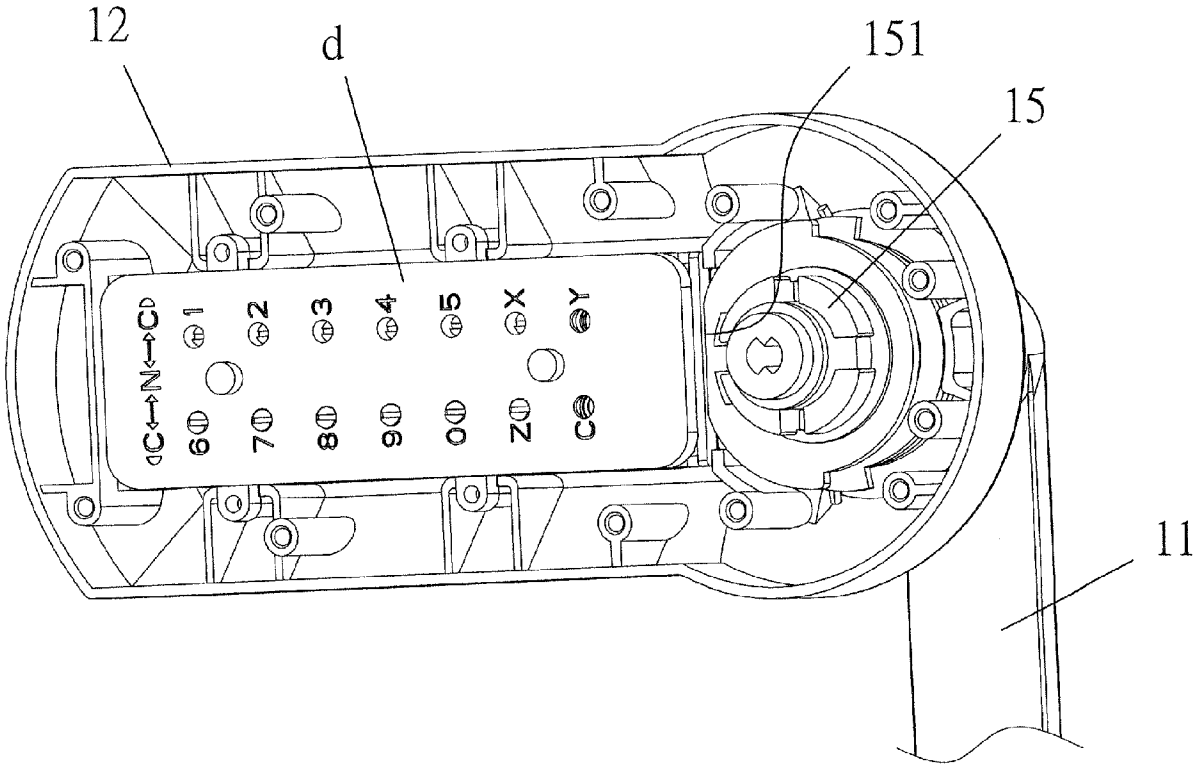
FIG. 13 is a schematic view illustrating an outdoor assembly of the present invention.

Further referring to FIGS. 10, 11, and 12, which are respectively an exploded view of the burglary protection block of the present invention, a schematic view illustrating installation of the burglary protection block, and a schematic view illustrating an operation of the burglary protection block according to the present invention, as shown in the drawings, the burglary protection block 15 comprises a plurality of ball grooves 151, a plurality of elastic elements 152, and a plurality of balls 153. The elastic elements 152 and the balls 153 are sequentially received in the ball grooves 151. With engagement established between the burglary protection block 15 and the code-change push plate b1, when the code-change push plate b1 is not in operation, since the burglary protection block 15 and the code-change push plate b1 are in engagement with each other, the burglary protection block 15 is not allowed to operate and only the elastic element arresting block is allowed to rotate so as to achieve an effect of burglary protection.

Figure 14:
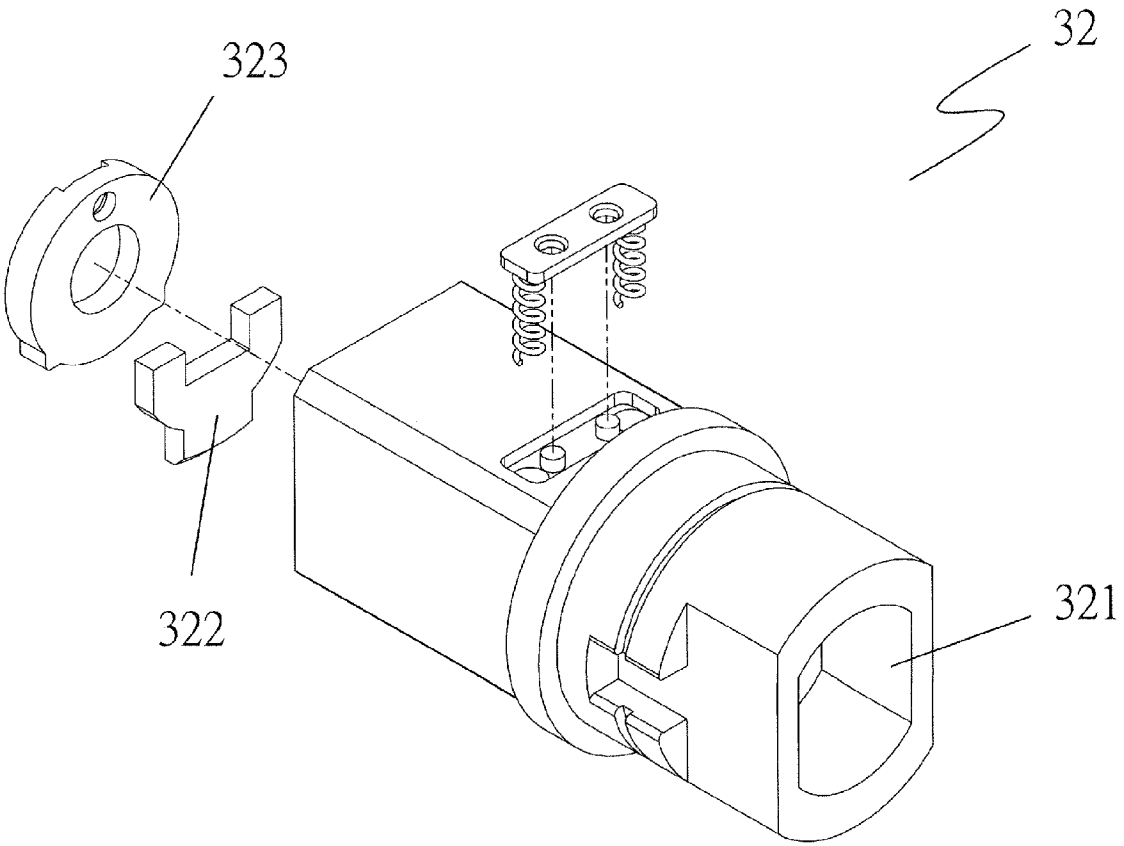
FIG. 14 is an exploded view of an internal handle coupling block of the present invention.
Figure 15:
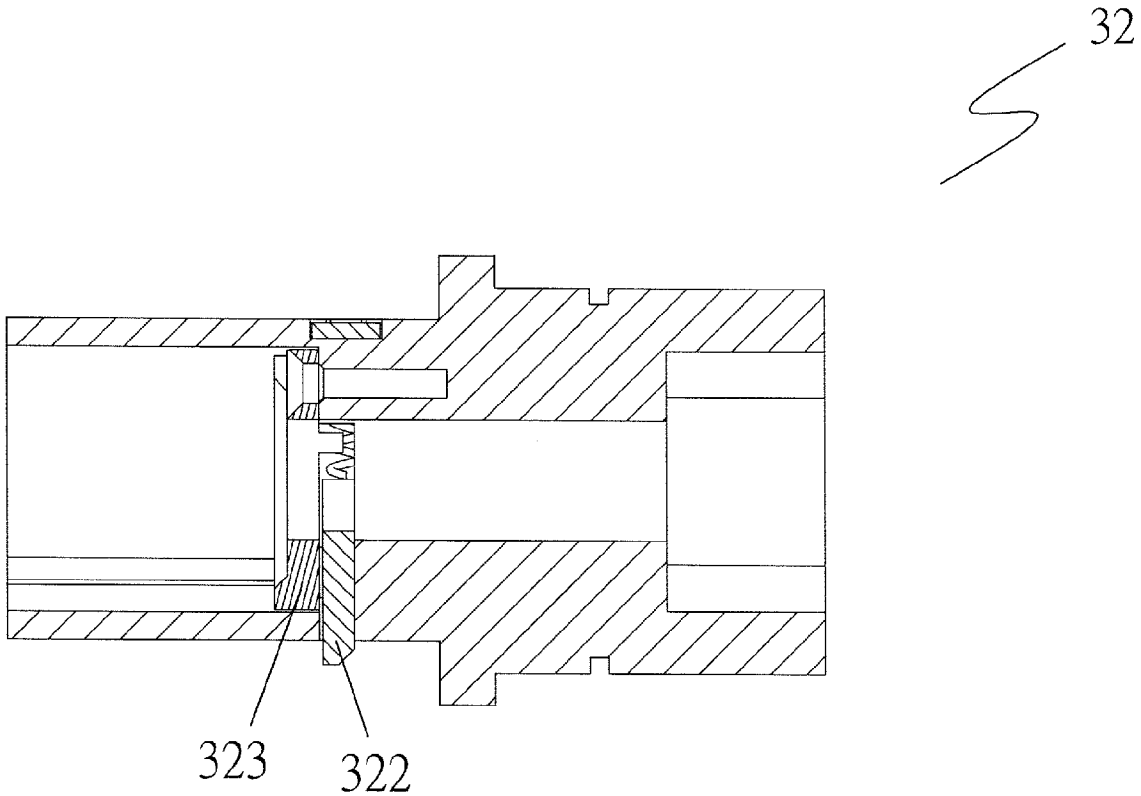
FIG. 15 is a cross-sectional view of the internal handle coupling block of the present invention.
Figure 16:
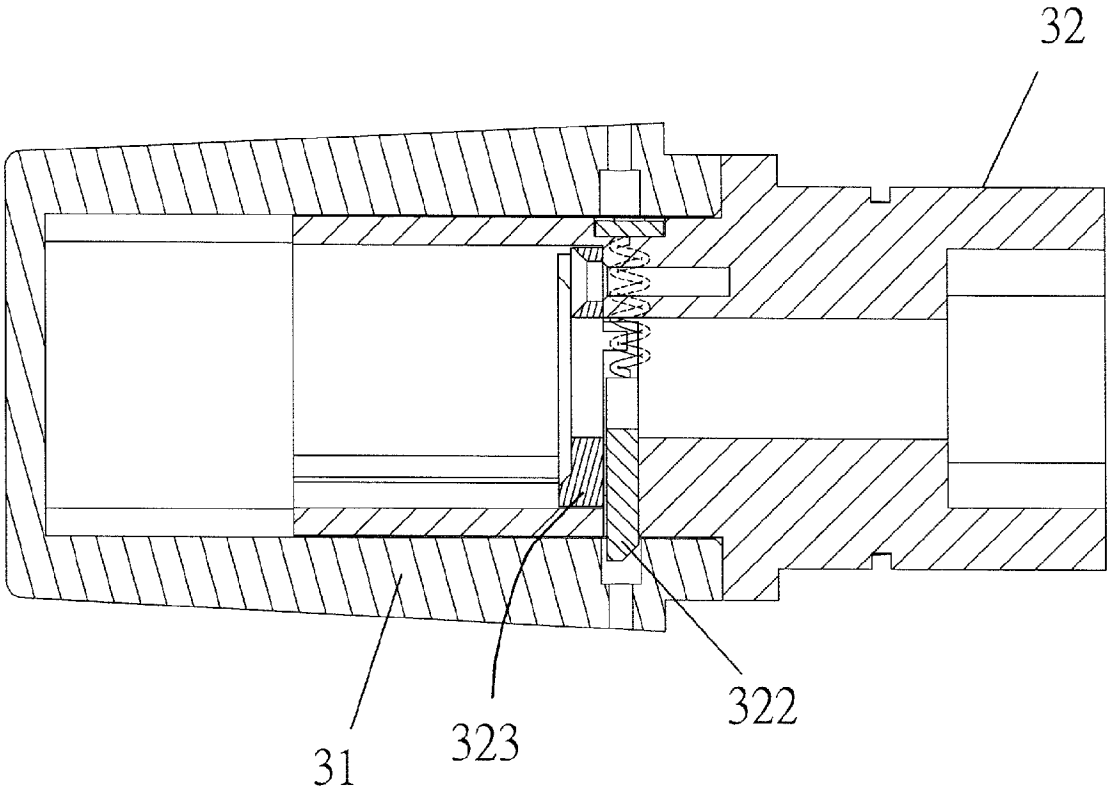
FIG. 16 is a schematic view illustrating coupling engagement of the internal handle coupling block and an internal door handle of the present invention.
Figure 17:
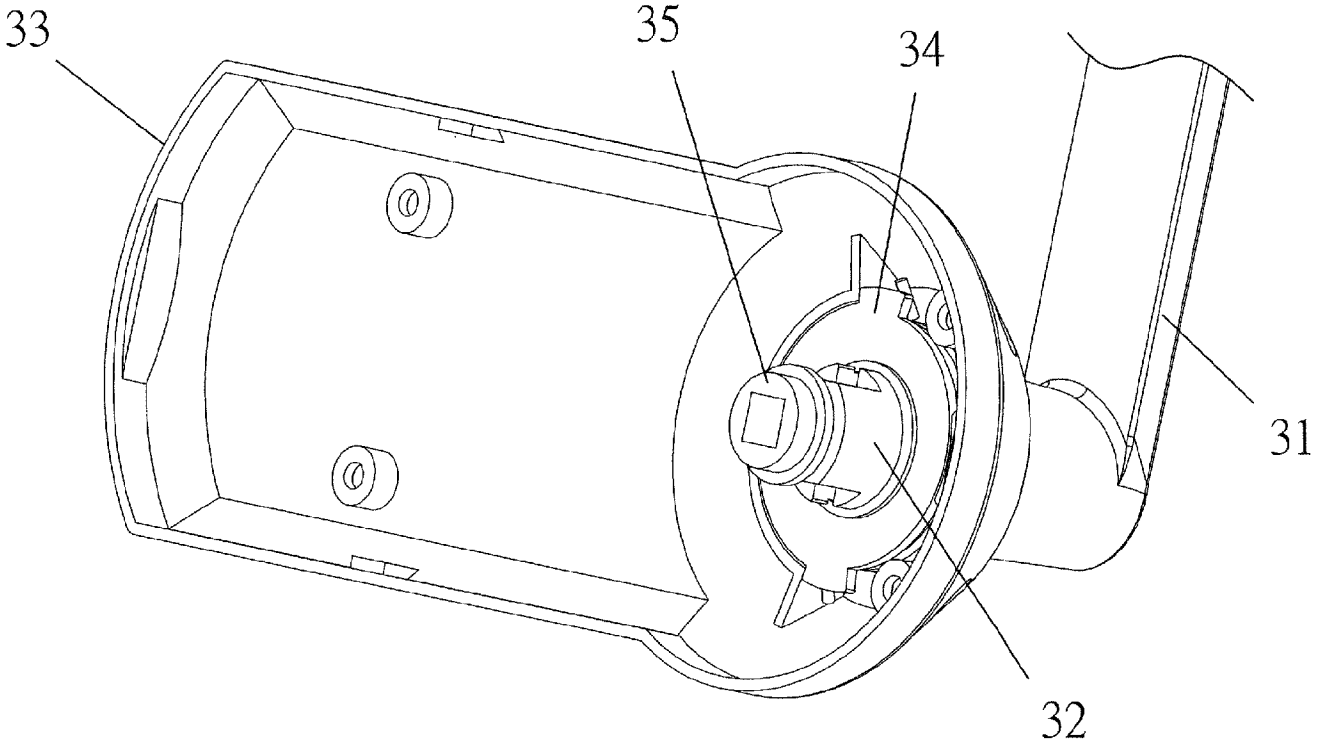
FIG. 17 is a schematic view illustrating an indoor assembly of the present invention.

Finally, referring to FIGS. 14, 15, and 16, which are respectively an exploded view of the internal handle coupling block of the present invention, a cross-sectional view of the internal handle coupling block, and a schematic view illustrating coupling engagement of the internal handle coupling block and the internal door handle of the present invention, as shown in the drawings, the internal handle coupling block 32 comprises an arresting member engagement slot 321 operatively coupled to the indoor arresting member 35, and comprises an engagement plate 322 for engagement with the internal door handle 31, and further comprises a retention plate 323 arranged at an outer side of the engagement plate 322 for fixing and retaining the engagement plate 322. The indoor arresting member 35 is also coupled to the latch bolt arresting member 2 so that when the internal door handle 31 is rotated, since the internal door handle 31 is operatively operatively coupled to the internal handle coupling block 32; the internal handle coupling block 32 is coupled to the indoor arresting member 35; and the indoor arresting member 35 is coupled to the latch bolt arresting member 2, the latch bolt arresting member is driven by the internal door handle 31 to urge the latch bolt 21 to move so as to directly open the door.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A pushbutton type easy-code-change handle lock, comprising:

an outdoor assembly, wherein the outdoor assembly, which is adapted to be mounted to an outside surface of a door panel, comprises an external door handle, an external escutcheon plate, an external handle coupling block, an elastic element arresting block, a burglary protection block, an outdoor arresting member, a mounting plate, and an outdoor fixing plate, the external escutcheon plate comprising a mechanical combination lock mounted thereto, the external handle coupling block, the elastic element arresting block, the burglary protection block and the outdoor arresting member being sequentially coupled to the external escutcheon plate and then coupled with the external door handle and the burglary protection block and the outdoor arresting member being securely held inside the external escutcheon plate by the mounting plate, the outdoor fixing plate fixing the outdoor assembly;

a latch bolt arresting member, which is coupled with the outdoor arresting member and extends through a latch bolt; and an indoor assembly, wherein the indoor assembly, which is adapted to be mounted to an inside surface of the door panel, comprises an internal door handle, an internal handle coupling block, an internal escutcheon plate, an elastic element arresting block, an indoor arresting member, and an indoor fixing plate, the internal handle coupling block, the elastic element arresting block, and the indoor arresting member being sequentially coupled to the internal escutcheon plate and then coupled with the internal door handle and the internal handle coupling block, the elastic element arresting block, and the indoor arresting member being fixed to the indoor assembly by the indoor fixing plate, whereby a pushbutton type easy-code-change handle lock is formed;

wherein the mechanical combination lock comprises a plurality of code change shafts, a code change device, and a code board, the code change shafts each comprising two position-limiting slots and a code channel formed therein, the code change device comprising a code-change push plate and a code change plate respectively provided with a first engagement block and a second engagement block that are respectively engageable with the position-limiting slots of each of the code change shafts and respectively located at opposite sides of the code change shaft, the code board being fit to the code change shafts, the code channels being engageable with the code change device.

2. The pushbutton type easy-code-change handle lock according to claim 1, wherein the external escutcheon plate comprises a pushbutton assembly for setting the mechanical combination lock.

* * * * *